US006326131B1

(12) United States Patent
Schell et al.

(10) Patent No.: US 6,326,131 B1
(45) Date of Patent: Dec. 4, 2001

(54) HIGHLY LUBRICATED IMAGING ELEMENT WITH HIGH COEFFICIENT OF FRICTION

(75) Inventors: Brian A. Schell, Honeoye Falls; Mridula Nair, Penfield, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/652,240

(22) Filed: Aug. 31, 2000

(51) Int. Cl.[7] ..... G03C 1/38; G03C 1/825; G03C 1/85; G03C 1/76; G03C 7/22

(52) U.S. Cl. ..... 430/505; 430/510; 430/523; 430/527; 430/531; 430/536; 430/537; 430/539; 430/961

(58) Field of Search ..... 430/523, 531, 430/961, 527, 510, 539, 536, 537, 505

(56) References Cited

U.S. PATENT DOCUMENTS 3,042,522 * 7/1962 Ben-Ezra ..... 430/539
3,489,567 * 1/1970 McGraw ..... 430/531
4,004,927 * 1/1977 Yamamoto ..... 430/523
4,675,278 * 6/1987 Sugimoto et al. ..... 430/961
5,137,802 * 8/1992 Ueda et al. ..... 430/523
5,529,891 * 6/1996 Wang et al. ..... 430/523
5,679,505 * 10/1997 Tingler et al. ..... 430/527
5,747,234 * 5/1998 Wexler et al. ..... 430/523

* cited by examiner

*Primary Examiner*—Richard L. Schilling
(74) *Attorney, Agent, or Firm*—Andrew J. Anderson

(57) ABSTRACT

An imaging element is disclosed comprising a support, an imaging layer, and an outermost protective layer on at least one side of the support which comprises a lubricant and an additive which is immiscible with and more surface active than the lubricant, wherein the lubricant is present in an amount of at least 5 mg/m$^2$ and the additive is present in an amount of at least 25 wt percent relative to that of the lubricant, the amount of additive being effective to increase the coefficient of friction for the outermost layer after coating and drying thereof relative to that obtained in the absence of the additive material. Imaging elements comprising highly lubricated protective outermost layers in accordance with the invention advantageously provide increased scratch and wear resistance, while the presence of an additive which is immiscible with and more surface active than the lubricant surprisingly has been found to increase the coefficient of friction to provide good manufacturability of the imaging element.

18 Claims, No Drawings

HIGHLY LUBRICATED IMAGING ELEMENT WITH HIGH COEFFICIENT OF FRICTION

FIELD OF THE INVENTION

The present invention relates to imaging elements, and more particularly in a specific embodiment to a motion picture print film photographic elements with improved resistance to abrasion and dust generation in projection equipment.

BACKGROUND OF THE INVENTION

Motion picture photographic film elements that are used as print films for movie theater projection have long used a carbon black-containing layer on the backside of the film. This backside layer provides both antihalation protection and antistatic properties prior to film processing. The carbon black is applied in an alkali-soluble binder that allows the layer to be removed by a process that involves soaking the film in alkali solution, scrubbing the backside layer, and rinsing with water. This carbon black removal process, which takes place prior to image development, is both tedious and environmentally undesirable since large quantities of water are utilized in this film processing step. In addition, in order to facilitate removal during film processing, the carbon black-containing layer is not highly adherent to the photographic film support and may dislodge during various film manufacturing operations such as film slitting and film perforating. Carbon black debris generated during these operations may become lodged on the photographic emulsion and cause image defects during subsequent exposure and film processing.

After removal of the carbon black-containing layer, antistatic properties provided thereby are lost. Undesired static charge build-up can then occur on processed motion picture print film when transported through projectors or on rewind equipment. While discharge of high static charges does not cause static marks on the processed photographic film as the film's light sensitive silver halide has also been removed during film processing, high static charges can attract dirt particles to the film surface. Once on the film surface, these dirt particles can create abrasion or scratches or, if sufficiently large, the dirt particles may be seen on the projected film image.

U.S. Pat. No. 5,679,505 describes a motion picture print film which, in place of a carbon black-containing layer on the backside of the film, contains an antihalation undercoat on the front side of the film support under the film emulsion layers, and an antistatic layer and a protective overcoat on the backside of the support. The protective overcoat is comprised of a polyurethane binder and lubricant. The polyurethane binder has a tensile elongation to break of at least 50% and a Young's modulus measured at 2% elongation of at least 50000 lb/in$^2$. Despite the toughness of this overcoat, abrasive wear and the subsequent dust generation have continued to be a problem with protective overcoats in motion picture print film. During the lifetime of a print in a theater, abrasions in the perforation area can become severe enough that the soundtrack is damaged. In addition, dust can build up in the picture area of the film and reduce the quality of the projected image.

One approach that greatly reduces projector dust is to heavily lubricate the overcoat. However, at the lubricant levels necessary to reduce dusting in projectors, the coefficient of friction of the overcoat is reduced to the point that such a film is non-manufacturable because support rolls have insufficient traction for satisfactory conveyance in high speed sensitizing machines, and also because the long, slit rolls of photographic film become telescoped or dished in storage or shipping, wherein the roll integrity is at risk. It would be desirable to reduce projector dust by providing a print film with a highly lubricated protective overcoat having a sufficiently high coefficient of friction to eliminate the above manufacturing difficulties.

SUMMARY OF THE INVENTION

In accordance with one embodiment of the invention, an imaging element is disclosed comprising a support, an imaging layer, and an outermost protective layer on at least one side of the support which comprises a lubricant and an additive which is immiscible with and more surface active than the lubricant, wherein the lubricant is present in an amount of at least 5 mg/m$^2$ and the additive is present in an amount of at least 25 wt percent relative to that of the lubricant, the amount of additive being effective to increase the coefficient of friction for the outermost layer after coating and drying thereof relative to that obtained in the absence of the additive material.

In accordance with a preferred embodiment of the present invention there is provided a motion picture photographic film element comprising a support having on a front side thereof an antihalation undercoat and at least one silver halide emulsion layer, and on the back side thereof an antistatic layer and an outermost protective layer which comprises a lubricant and an additive as described above.

In accordance with a particularly preferred embodiment of the present invention there is provided a color motion picture print film element comprising a support having on a front side thereof, in order, an antihalation undercoat, a yellow dye image-forming unit comprising at least one blue-sensitive silver halide emulsion layer having associated therewith at least one yellow dye-forming coupler, a cyan dye image-forming unit comprising at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler, and on the backside thereof an antistatic layer and an outermost protective layer which comprises a lubricant and an additive as described above.

Imaging elements comprising highly lubricated protective outermost layers in accordance with the invention advantageously provide increased scratch and wear resistance, while the presence of an additive which is immiscible with and more surface active than the lubricant surprisingly has been found to increase the coefficient of friction to provide good manufacturability of the imaging element.

DETAILED DESCRIPTION OF THE INVENTION

Outermost protective layers in accordance with this invention can be used for many different types of imaging elements where it is desirable to provide increased protection against wear (e.g., during manufacture or subsequent use of the imaging element) while retaining sufficiently high coefficients of friction to enable good manufacturability. The outermost protective layers in accordance with the invention are particularly useful as protective layers coated over imaging element antistatic layers. While the invention is applicable to a variety of imaging elements such as, for example, photographic, electrostatophotographic, photothermographic, migration, electrothermographic, dielectric recording and thermal-dye-transfer imaging elements, the invention is primarily applicable to photographic elements, particularly silver halide photographic elements, and more particularly motion picture print film elements. Accordingly, for the purpose of describing this invention and for simplicity of expression, photographic elements will be primarily referred to throughout this specification; however, it is to be understood that the invention also applies to other forms of imaging elements.

The materials employed as the support member for imaging elements in accordance with the invention may be, e.g., paper, synthetic high molecular weight polymeric materials, or laminates thereof. These materials may be comprised of various polymeric films, but polyester (e.g., poly(ethylene terephthalate) and poly(ethylene naphthalate)) and cellulose triacetate film supports, which are well known in the art, are preferred. The thickness of the support is not critical. Conventional support member thicknesses of from about 50 to 250 microns (2 to 10 mils, or 0.002 to 0.010 inches) can be employed, for example, with very satisfactory results. Polyester supports typically employ an undercoat or primer layer between the polyester support and functional layers coated thereon. Such primer layers are well known in the art and may comprise, for example, a vinylidene chloride/methyl acrylate/itaconic acid terpolymer or vinylidene chloride/acrylonitrile/acrylic acid terpolymer as described in U.S. Pat. Nos. 2,627,088, 2,698,235, 2,698,240, 2,943,937, 3,143,421, 3,201,249, 3,271,178 and 3,501,301.

The image-forming layer for imaging elements in accordance with the invention may be present on the same side of the support as the highly lubricated outermost protective layer or on the opposite side. In preferred embodiments of the invention, the imaging element comprises a photographic element, and the image forming layer comprises a silver halide emulsion layer on the front side of the support, while the highly lubricated outermost protective layer is on the backside of the support. In addition to silver halide emulsion image-forming layers, the image-forming layer of imaging elements in accordance with the invention may comprise, e.g., any of the other image forming layers described in U.S. Pat. No. 5,457,013, the disclosure of which is incorporated by reference herein.

Imaging elements in accordance with the invention comprise an outermost protective layer on at least one side of the support thereof comprising a relatively high level of a lubricant i.e. dry coverage of at least 5 mg/m$^2$, preferably at least 10 mg/m$^2$, and more preferably from 10 to 20 mg/m$^2$. Such high levels of lubricants provides improved wear performance in movie projectors and other apparatus through which imaging elements may be conveyed, by reducing abrasions and dust generation. Lubricant levels of above 20 mg/m$^2$ may be employed, but typically will provide little additional wear protection. Many lubricating agents can be used in the outermost layer in accordance with the invention, including higher alcohol esters of fatty acids, higher fatty acid calcium salts, metal stearates, paraffins and the like as described in, e.g., U.S. Pat. Nos. 2,588,756, 3,121,060, 3,295,979, 3,042,522 and 3,489,567. Aqueous dispersed lubricants are strongly preferred, since lubricants in this form can be incorporated directly into an aqueous coated protective topcoat formula, thus avoiding the need for a separately applied lubricant overcoat on the protective topcoat layer. The aqueous dispersed lubricants of carnauba wax, polyethylene oxide, microcrystalline wax, paraffin wax, stearates and amides work well as lubricants in aqueous coated protective topcoats.

At high lubricant coverages in accordance with the invention, the coefficient of friction for the imaging element surface may drop to about 0.10. At a coefficient of friction below 0.20, there is a significant danger that long, slit rolls of photographic film will become unstable in storage or shipping and become telescoped or dished, a condition common to unstable film rolls. The inventors have surprisingly found that the incorporation of and an additive which is immiscible with and more surface active than the lubricant into the outermost protective layer can substantially raise the coefficient of friction of the outermost protective layer, while maintaining the improved wear properties provided by the high levels of lubricant. The amount of additive included in the outermost layer should be effective to increase the coefficient of friction for the outermost layer after coating and drying thereof relative to that obtained in the absence of the additive material. To desirably provide a coefficient of friction for the outermost protective layer of at least 0.20, the additive is preferably present in an amount of at least 25 wt percent, more preferably at least 50 wt percent, and most preferably at least 100 wt percent, relative to that of the lubricant. What is necessary for the additive to be effective is that it must be more surface active than the lubricant so as to form a continuous layer on the outermost surface of the element. The additive must also be immiscible with the lubricant so the two exist as separate phases on the surface. Lastly, of course, the additive must not itself substantially lower the coefficient of friction.

In accordance with a particular embodiment of the invention, water-soluble fluorine-containing surfactants (fluorosurfactants) may be employed as the additive in combination with the above described wax lubricants. While fluorine-containing surfactants have been conventionally employed at relatively low levels as coating aids in aqueous coatings, it has been surprisingly found that they may be used in highly lubricated protective outermost layers at sufficiently high levels (relative to the amount of lubricant) effective to raise the friction of such layers to nearly that of a layer with no lubricant at all. Fluorine-containing surfactants which are preferably used in the present invention include compounds having a perfluoroalkyl or perfluoroalkenyl group which has at least 6 carbon atoms, and which have, as the water soluble group, an anionic group, a cationic group, a betaine group, or a nonionic group. Examples of the fluorine-containing surfactants include, for example, Fluorad FC series manufactured by 3M Company, Zonyl series manufactured by E. I. Du Pont De Nemours & Co., and Fluorotenside FT series manufactured by Bayer A G. One specific fluorosurfactant that is effective in this regard is the tetraethylammonium salt of perfluorooctyl sulfonic acid, produced as Fluorotenside FT-248 by Bayer, A G. Other combinations of lubricant and relatively surface active, lubricant-immiscible additives, including other fluorosurfactants, may also be employed.

Outermost protective layers in accordance with the invention typically (though not necessarily) will also comprise a film-forming binder and matting agent. The film-forming binder can be essentially any known polymeric binder. This includes hydrophilic colloids such as gelatin as well as hydrophobic polymers. Particularly preferred polymeric binders for use in the highly lubricated outermost protective layer include aliphatic polyurethanes such as those described in U.S. Pat. No. 5,679,505 which is incorporated herein by reference.

In a particularly preferred embodiment, photographic imaging elements of the invention include an antistatic layer whose antistatic properties survive photographic processing. The antistatic layers may include a variety of electrically conductive metal-containing particles, such as metal oxides, dispersed in a binder material. Examples of useful electrically conductive metal-containing particles include donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103; 4,394,441; 4,416,963; 4,418,141; 4,431,764; 4,495,276; 4,571,361; 4,999,276; 5,122,445 and 5,368,995. Other useful electrically conductive materials for use in antistatic layers include: semiconductive metal salts such as cuprous iodide as described in U.S. Pat. Nos. 3,245,833, 3,428,451 and 5,075,171; fibrous conductive powders comprising, for example, antimony-doped tin oxide coated onto non-conductive potassium titanate whiskers as described in U.S. Pat. Nos. 4,845,369 and 5,116,666; conductive polymers, such as, the cross-linked vinylbenzyl quaternary ammonium polymers of U.S. Pat. No. 4,070,189, the conductive polyanilines of U.S. Pat. No. 4,237,194, and conductive polythiophenes of U.S. Pat. Nos. 4,987,042, 5,035,926, 5,354,613, 5,370,981, 5,372,924, 5,543,944 and 5,766,515; a colloidal gel of vanadium pentoxide or silver-doped vanadium pentoxide as described in U.S. Pat. Nos. 4,203,769, 5,006,451, 5,221,598 and 5,284,714. Typically, the antistatic layer will be coated at a dry coverage of from 1 to 1000 $mg/m^2$ based on total dry weight. The electrical resistivity of the antistatic layer is preferably from about 7 to about 11 log Ω/□, more preferably from about 8 to 9 log Ω/□.

The antistatic layer may be present on either side or both sides of the support material. The antistatic layer may be an internal layer that underlies the imaging layer, or a layer with is coated over the imaging layer or on the side of the support opposite to the imaging layer. The outermost protective layer may be coated over the antistatic layer, or the electrically conductive material may be included in the outermost protective layer. While many metal oxide particles do not require chemical barriers to protect them against harsh environments, such as photographic processing solutions, an abrasion resistant topcoat is still often desirable for good physical durability of the layers as many of these metal oxides require high particle loading in a binder to obtain good conductivity, which high particle loading can degrade the physical properties of the layer.

A preferred antistatic layer contains vanadium pentoxide as described in one of the aforementioned patents. The antistatic layer described in U.S. Pat. No. 4,203,769 is prepared by coating an aqueous colloidal solution of vanadium pentoxide. Preferably, the vanadium pentoxide is doped with silver. A polymer binder, such as a vinylidene-chloride-containing terpolymer latex or a polyesterionomer dispersion, is preferably employed in the antistatic layer to improve the integrity of the layer and to improve adhesion to the undercoat layer. Typically the dried coating weight of the vanadium pentoxide antistatic material is about 0.5 to 30 $mg/m^2$. The weight ratio of polymer binder to vanadium pentoxide can range from about 1:5 to 500:1, preferably 0.5:1 to 10:1.

The antistatic coating formulation may also contain a coating aid to improve coatability. The common level of coating aid in the antistatic coating formula is 0.01 to 0.30 weight percent active coating aid based on the total solution weight. However, the preferred level of coating aid is 0.02 to 0.20 weight percent active coating aid based on total solution weight. These coating aids can be either anionic or nonionic coating aids such as paraisononyphenoxy-glycidol ethers, octylphenoxy polyethoxy ethanol, sodium salt of alkylaryl polyether sulfonate, and dioctyl esters of sodium sulfosuccinic acid, which are commonly used in aqueous coatings. The coating may be applied onto the film support using coating methods well known in the art such as hopper coating, skim pan/air knife, gravure coating, and the like.

In accordance with preferred embodiments of the invention, where the outermost protective layer is coated over an antistatic layer, the outermost protective layer comprises a polyurethane binder such as described in U.S. Pat. No. 5,679,505 incorporated by reference above. Preferably, the polyurethane is an aliphatic polyurethane. Aliphatic polyurethanes are preferred due to their excellent thermal and UV stability and freedom from yellowing. Preferred polyurethanes are characterized as those having a tensile elongation to break of at least 50% and a Young's modulus measured at an elongation of 2% of at least 50,000 $lb/in^2$. These physical property requirements insure that the outermost protective layer is hard yet tough to simultaneously provide excellent abrasion resistance and outstanding resiliency to allow the protective layer and antistat layer to survive hundreds of cycles through apparatus such as a motion picture projector. The polyurethane protective layer is preferably coated from a coating formula containing from about 0.5 to about 10.0 weight percent of polyurethane to give a dry coverage of from about 50 to about 3000 $mg/m^2$. The dry coverage of the protective layer is preferably from about 300 to 2000 $mg/m^2$.

The polyurethane may be either organic solvent soluble or aqueous dispersible. For environmental reasons, aqueous dispersible polyurethanes are preferred. Preparation of aqueous polyurethane dispersions is well-known in the art and involves chain extending an aqueous dispersion of a prepolymer containing terminal isocyanate groups by reaction with a diamine or diol. The prepolymer is prepared by reacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion. The chemical resistance of the polyurethane protective layer can be improved by adding a crosslinking agent that reacts with functional groups present in the polyurethane, for example, carboxyl groups. Crosslinking agents such as aziridines, carbodiimides, epoxies, and the like are suitable for this purpose. The crosslinking agent can be used at about 0.5 to about 30 weight percent based on the polyurethane. However, a crosslinking agent concentration of about 2 to 12 weight percent based on the polyurethane is preferred.

Preferably, the outermost protective layers of the elements of the invention contain matte particles. In addition to lubricants, matting agents are useful in the outermost protective layer for improving the transport of imaging elements on manufacturing, printing, processing, and projecting equipment. Also, these matting agents can reduce the potential for the outermost protective layer to ferrotype when in contact with the emulsion side surface of a photographic element under the pressures that are typical of roll films. The term "ferrotyping" is used to describe the condition in which the backside outermost protective layer, when in contact with the emulsion side under pressure, as in a tightly wound roll, adheres to the emulsion side sufficiently strongly that some sticking is noticed between the backside protective layer and the emulsion side surface layer when they are separated. In severe cases of ferrotyping, damage to the emulsion side surface may occur when the backside protective layer and emulsion side surface layer are separated. This severe damage may have an adverse sensitometric effect on the emulsion. The matting agent may be silica, calcium carbonate, or other mineral oxides, glass spheres, ground polymers and high melting point waxes, and polymeric matte beads. Polymeric matte beads are preferred because of uniformity of shape and uniformity of size distribution. The matte particles should have a mean diameter size of about 0.5 to about 3 micrometers. However, preferably the matte particles have a mean diameter of from about 0.75 to about 2.5 micrometers. The matte particles can be employed at a dry coating weight of about 1 to about 100 $mg/m^2$. However, the preferred coating weight of the matte particles is about 15 to about 65 $mg/m^2$. The surface roughness (Ra, ANSI Standard B46.1, 1985) in microns should be in the range 0.010 to 0.060 to prevent ferrotyping of the emulsion surface. However, the preferred Ra value range is from 0.025 to 0.045 for best performance. If the Ra value is below 0.025, there is insufficient surface roughness to prevent slight emulsion surface marking from ferrotyping between the backing and emulsion. If the Ra value is above 0.045, there is sufficient surface roughness with these size matte particles to show some low level of emulsion granularity and loss of picture sharpness, especially under the very high magnifications typical of movie theater projection.

Photographic elements in accordance with the preferred embodiment of the invention can be simple black and white or monochrome (single color) elements, or multicolor elements. Multicolor elements typically contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, subbing layers, and the like. The silver halide emulsion layers of dye-image forming units and any emulsion intercoat layers will comprise a hydrophilic binder, typically gelatin.

The invention specifically contemplates use of highly lubricated outermost protective layers in combination with technology useful in small format film as described in Research Disclosure, June 1994, Item 36230. Photographic elements in accordance with one embodiment of the invention may be used in conjunction with an applied magnetic layer as described in Research Disclosure, November 1992, Item 34390. Research Disclosure is published by Kenneth Mason Publications, Ltd., Dudley House, 12 North Street, Emsworth, Hampshire P010 7DQ, ENGLAND. In the following discussion of suitable materials for use in the photographic emulsions and imaging elements that can be used in conjunction with the highly lubricated outermost protective layers of the invention, reference will be made to Research Disclosure, September 1994, item 36544, available as described above, which will be identified hereafter by the term "Research Disclosure." The Sections hereafter referred to are Sections of the Research Disclosure, Item 36544.

The light-sensitive silver halide emulsions employed in emulsion layers of photographic elements can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

Dye-image-providing materials can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivaloylacetanilides.

In accordance with a preferred embodiment of this invention, an antihalation undercoat layer is present between the support and the image forming emulsion layers, and is used to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes can be used for this purpose. Such dyes should be incorporated in the antihalation undercoat with a mordant to prevent dye diffusion. Alternatively, and preferably, a solid particle filter dye is incorporated in the antihalation undercoat.

Useful water-soluble filter dyes include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486, 897; 3,652,284 and 3,718,472, the enamino hemioxonol dyes of U.S. Pat. No. 3,976,661, the cyanomethyl sulfone-derived merocyanines of U.S. Pat. No. 3,723,154, the thiazolidones, benzotriazoles, and thiazolothiazoles of U.S. Pat. Nos. 2,739,888; 3,253,921; 3,250,617 and 2,739,971, the triazoles of U.S. Pat. No. 3,004,896, and the hemioxonols of U.S. Pat. Nos. 3,125,597 and 4,045, 229. Useful mordants are described, for example, in U.S. Pat. Nos. 3,282,699; 3,455,693; 3,438,779 and 3,795,519.

Preferred examples of solid particle filter dyes for use in antihalation undercoat layers include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D—(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxonol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179 and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$$[D—(A)_y]—X_n$$

where D, X and n are as defined above, and A is an aromatic ring bonded directly or indirectly to D, y is 0 to 4, and X is bonded either on A or an aromatic ring portion of D.

Exemplary dyes of the above formulas include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above. Preferred examples of solid particle filter dyes include the following:

D-1

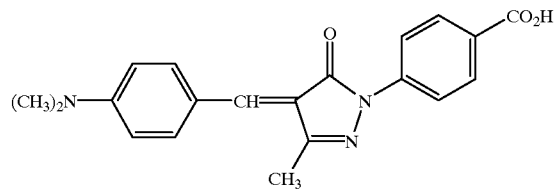

D-2

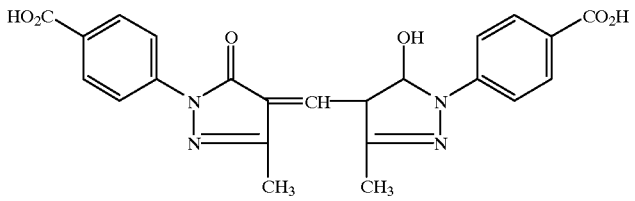

D-3

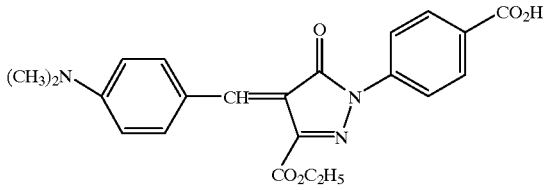

-continued

D-4

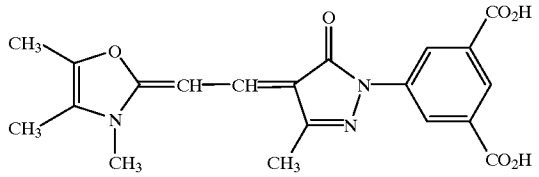

D-5

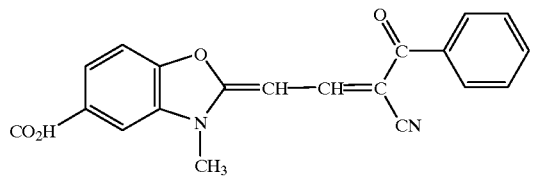

D-6

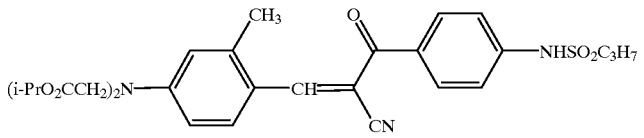

D-7

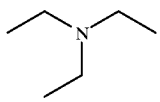

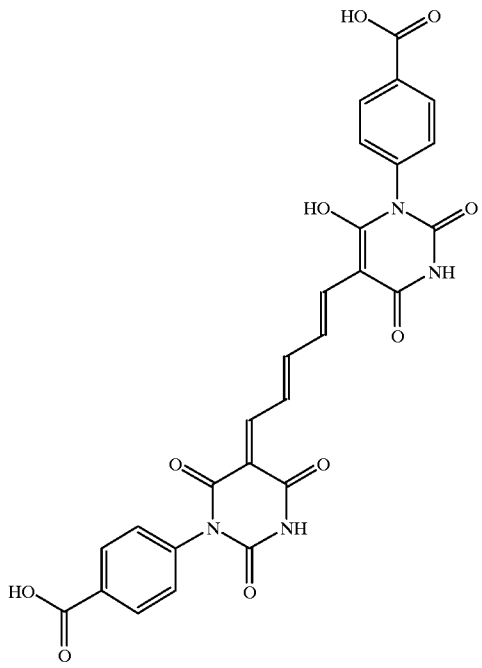

To promote adhesion of the antihalation undercoat to the support, primer layers as hereinabove described are advantageously employed, especially when the support is a polyester support.

The use of film-forming hydrophilic colloids as binders in photographic elements, including photographic films and photographic papers, is very well known. The most commonly used of these is gelatin and gelatin is a particularly preferred material for use in this invention. It can be used as the binder in the antihalation underlayer and in the silver halide emulsion layer(s). Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

In accordance with preferred embodiments of the invention, the imaging element comprises a motion picture film element, and more preferably a motion picture print film element, as such film elements are particularly in need of protective layers providing good anti-wear performance and adequate friction to provide good manufacturability. Motion picture film elements typically have a width of up to 100 millimeters (or only up to 70 or 50 millimeters), and a length of at least 30 meters (or optionally at least 100 or 200 meters). In motion picture printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film.

Motion picture film photographic elements in accordance with preferred embodiments of the invention comprise a support having on a front side thereof an antihalation undercoat layer and at least one silver halide emulsion layer, and an antistatic layer and a highly lubricated outermost protective layer on the backside thereof. The invention is applicable to color photographic print and intermediate film elements as well as black and white motion picture photographic film elements. A multicolor photographic print film element in accordance with particularly preferred embodiments of the invention comprises a support bearing on a front side thereof, in order, an antihalation undercoat, a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler, and on the backside thereof an antistatic layer and a highly lubricated outermost protective layer.

Photographic print films typically use relatively small grain, high chloride silver halide emulsions (e.g., emulsions having average grain size equivalent circular diameters of less than about 1 micron and halide contents of greater than 50 mole % chloride) in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use. The emulsions typically will be gelatin emulsions although other hydrophilic colloids can be used in accordance with usual practice. The compositions of typical light sensitive image recording layers used in print films are well known, and are not critical to the invention, as any of the silver halide materials used in conventional motion picture films may be used, such as those described, e.g., in *Research Disclosure,* Item 36544, September, 1994, and the references listed therein.

The following examples are intended to illustrate the present invention but not to limit it in scope in any way.

EXAMPLES

Support and Backing Preparation and Evaluation

Subbed polyethylene terephthalate supports were prepared by applying a subbing terpolymer of acrylonitrile, vinylidene chloride and acrylic acid to both sides of a polyester film, and subsequently drafting and tentering the film so that the final coating weight was about 90 mg/m$^2$. An antistatic layer formulation was then coated on one side of the subbed polyester supports. The antistat layers consisted in dry coverages of 2.8 mg/m$^2$ of an acrylonitrile/vinylidene chloride/acrylic acid terpolymer (supplied as 30% dispersion), 2.15 mg/m$^2$ vanadium pentoxide (supplied as 0.57% colloidal dispersion), and 3.23 mg/m$^2$ Olin 10G surfactant. Protective topcoat formulations were then used to overcoat the antistatic layers. All the protective topcoats included in dry coverages of 972 mg/m$^2$ of Sancure 898 polyurethane (supplied as 32% dispersion), 26.9 mg/m$^2$ 2 mm polymethyl methacrylate matte beads (supplied as 23.8% dispersion), 60.7 mg/m$^2$ polyfunctional aziridine crosslinker (supplied as 50% dispersion), and 9.7 mg/m$^2$ Triton X-100 surfactant (Rohm & Haas)(supplied as 10% dispersion), as well as Michemlube 124 (Michelman Inc.) synthetic hydrocarbon wax and/or Fluorotenside FT-248 (Bayer A G) tetraethylammonium salt of perfluorooctyl sulfonic acid in the amounts indicated in Table 1 below. Examples were prepared for four different protective overcoat formulations, and after coating and drying the coefficient of friction of the overcoats was measured as indicated in Table 1:

TABLE 1

| | COF Results | | |
|---|---|---|---|
| Example | Wax[1] (mg/m$^2$) | Fluorosurfactant[2] (mg/m$^2$) | COF |
| 1 (Comparative) | 0.65 | none | .40 |
| 2 (Comparative) | 13.5 | 1.78 | .10 |
| 3 (Comparative) | None | 14.5 | .50 |
| 4 (Invention) | 13.5 | 14.5 | .30 |

[1]Michemlube 124, synthetic hydrocarbon wax, is a product of Michelman Inc.
[2]Fluorotenside FT-248, the tetraethylammonium salt of perfluorooctyl sulfonic acid, is a product of Bayer AG.

As can be seen from the table, Example 2 has a greatly reduced COF due to the increase in wax level. It can also be seen from Example 3 that the fluorosurfactant by itself raises the COF. Increasing the fluorosurfactant in the invention restores the COF nearly to that of Example 1 despite the high lubricant level.

Motion Picture Print Film Preparation and Evaluation

Examples 1, 2 and 4 were then coated on a high-speed coating machine with an antihalation undercoat, silver halide emulsion layers suitable for color motion picture print film, and a conventional emulsion overcoat containing 1000 mg/m$^2$ gelatin, 5 mg/m$^2$ of 2 mm polymer matte and polydimethyl siloxane lubricant. Though the supports of Examples 1 and 4 had satisfactory conveyance, that of Example 2 had many fine scratches due to its poor traction.

The sample films were slit, perforated, and wound as 6000 foot by 35 mm rolls and a roll telescoping test performed. This test determines the force needed to cause the roll to dish at a set distance from the core. This test is typically performed on finished film fresh and two weeks later after the support has relaxed under tension. Rolls approaching 200 lbs of force in this test are susceptible to telescoping in handling and storage; with higher forces better. The results are reported in Table 2:

TABLE 2

| Telescoping Tests | | |
|---|---|---|
| | Force in lbs. to Dish @ 3" | |
| Example | Initial | 2 Weeks |
| 1 (Comparison) | 425 | 290 |
| 2 (Comparison) | 225 | 230 |
| 4 (Invention) | 410 | 300 |

It is clear from the table that the increased wax in Example 2 places such rolls at risk of dishing, whereas the invention eliminates this disadvantage.

The films were processed in a conventional motion picture film processor and run through a Projector Abrasion Test. In this test, a continuous loop of film is passed through a Motion Picture photographic film projector for 200 passes to simulate normal film life in a movie theater. The tested film is removed from the Projector Abrasion Tester and examined for abrasion or scratches around the perforation holes in those areas in which the film surface contacted the projector. The film was rated as excellent, good, or poor based on this examination. The amount of dust buildup on the film was rated on a scale of 1 to 4, with 1 being best—essentially no dusting—and 4 being worst. The results are reported in Table 3:

TABLE 3

| Projector Wear Results | | |
|---|---|---|
| Example | Scratch Rating | Dusting |
| 1 (Comparison) | Poor | 3 |
| 2 (Comparison) | Good to Excellent | 1 |
| 4 (Invention) | Good to Excellent | 1 |

The high levels of lubricant clearly demonstrate an advantage in the form of increased scratch resistance and decreased dusting during film projection.

Processed samples of Example 2 and the invention were wound onto a platter system as is often employed in movie theaters. Such a system typically consists of an upper and a lower turntable with a projector between the two. It is common in theaters for a projectionist to manually move the loosely wound doughnut of film from one platter to another between showings. After one cycle of use, this was attempted with Example 2, which fell apart. The film of the invention, on the other hand, could easily be moved from one platter to another and remained intact. X-ray photoelectron spectroscopy performed on a processed sample of the invention indicated that the fluorosurfactant was quantitatively removed during processing. Despite the removal of fluorosurfactant from the surface of the protective overcoat of the invention during processing, the lubricant apparently still does not form a continuous film under the mild drying conditions employed, thereby maintaining a higher coefficient of friction.

While the invention has been described in detail with particular reference to preferred embodiments, it will be understood that variations and modifications can be effected within the spirit and scope of the invention.

What is claimed is:

1. An imaging element comprising a support, an imaging layer, and an outermost protective layer on at least one side of the support which comprises a lubricant and an additive which is immiscible with and more surface active than the lubricant, wherein the lubricant is present in an amount of at least 5 mg/m$^2$ and the additive comprises a water-soluble fluorine-containing surfactant which is present in an amount of at least 25 wt percent relative to that of the lubricant, the amount of additive being effective to increase the coefficient of friction for the outermost layer after coating and drying thereof relative to that obtained in the absence of the additive material, wherein the lubricant comprises an aqueous dispersed carnauba wax, polyethylene oxide, microctystalline wax, paraffin wax, stearate or amide which is present in the outermost layer in an amount which would be effective to provide a coefficient of friction of less than 0.20 in the absence of the additive, and the additive is present in an amount effective provide a coefficient of friction for the outermost protective layer of at least 0.20 after coating and drying of the outermost protective layer.

2. An element according to claim 1, wherein the additive is present in an amount of at least 50 wt percent relative to that of the lubricant in the outermost protective layer.

3. An element according to claim 1, wherein the additive is present in an amount of at least 100 wt percent relative to that of the lubricant in the outermost protective layer.

4. An element according to claim 1, wherein the lubricant is present in the outermost protective layer in an amount of at least 10 mg/m$^2$.

5. An element according to claim 1, wherein the outermost protective layer comprises a polymeric binder.

6. An element according to claim 1, wherein the fluorine-containing surfactant comprises a compound having a perfluoroalkyl or perfluoroalkenyl group which has at least 6 carbon atoms, and an anionic, a cationic, a betaine, or a nonionic water soluble group.

7. An element according to claim 6, wherein the additive comprises the tetraethylammonium salt of perfluorooctyl sulfonic acid.

8. An element according to claim 1 comprising a photographic element, wherein the imaging layer comprises a silver halide emulsion layer on a front side of the support, and the outermost protective layer is on a backside of the support.

9. An element according to claim 8, further comprising an antistatic layer between the support and the outermost protective layer.

10. An element according to claim 9, further comprising an antihalation undercoat between the support and the imaging layer.

11. An element according to claim 9, wherein the outermost protective layer comprises a polyurethane binder which has a tensile elongation to break of at least 50% and a Young's modulus measured at a 2% elongation of at least 50000 lb/in$^2$.

12. An element according to claim 8 comprising yellow, magenta, and cyan dye image-forming units comprising light-sensitive silver halide emulsion layers.

13. A motion picture photographic film element comprising a support having on a front side thereof an antihalation undercoat and at least one silver halide emulsion layer, and on the back side thereof an antistatic layer and an outermost protective layer which comprises a lubricant and an additive which is immiscible with and more surface active than the lubricant, wherein the lubricant is present in an amount of at least 5 mg/m$^2$ and the additive comprises a water-soluble fluorine-containing surfactant which is present in an amount of at least 25 wt percent relative to that of the lubricant, the amount of additive being effective to increase the coefficient of friction for the outermost layer after coating and drying thereof relative to that obtained in the absence of the additive material, wherein the lubricant comprises an aqueous dispersed carnauba wax, polyethylene oxide, microcrystalline wax, paraffin wax, stearate or amide which is present in the outermost layer in an amount which would be effective to provide a coefficient of friction of less than 0.20 in the absence of the additive, and the additive is present in an amount effective provide a coefficient of friction for the outermost protective layer of at least 0.20 after coating and drying of the outermost protective layer.

14. A color motion picture print film element comprising a support having on a front side thereof, in order, an antihalation undercoat, a yellow dye image-forming unit comprising at least one blue-sensitive silver halide emulsion layer having associated therewith at least one yellow dye-forming coupler, a cyan dye image-forming unit comprising at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler, and on the backside thereof an antistatic layer and an outermost protective layer which comprises a lubricant and an additive which is immiscible with and more surface active than the lubricant, wherein the lubricant is present in an amount of at least 5 mg/m$^2$ and the additive comprises a water-soluble fluorine-containing surfactant which is present in an amount of at least 25 wt percent relative to that of the lubricant, the amount of additive being effective to increase the coefficient of friction for the outermost layer after coating and drying thereof relative to that obtained in the absence of the additive material, wherein the lubricant comprises an aqueous dispersed carnauba wax, polyethylene oxide, microcrystalline wax, paraffin wax, stearate or amide which is present in the outermost layer in an amount which would be effective to provide a coefficient of friction of less than 0.20 in the absence of the additive, and the additive is present in an amount effective provide a coefficient of friction for the outermost protective layer of at least 0.20 after coating and drying of the outermost protective layer.

15. An element according to claim 14, wherein the lubricant is present in the outermost protective layer in an amount of at least 10 mg/m$^2$.

16. An element according to claim 14, wherein the additive comprises a water-soluble fluorine-containing surfactant compound having a perfluoroalkyl or perfluoroalkenyl group which has at least 6 carbon atoms, and an anionic, a cationic, a betaine, or a nonionic water soluble group.

17. An element according to claim 16, wherein the additive comprises the tetraethylammonium salt of perfluorooctyl sulfonic acid.

18. An imaging element comprising a support, an imaging layer, and an outermost protective layer on at least one side of the support which comprises: a hydrocarbon wax lubricant; an additive which comprises a water-soluble fluorine-containing surfactant having a perfluoroalkyl or perfluoroalkenyl group which has at least 6 carbon atoms, and an anionic, a cationic, a betaine, or a nonionic water soluble group and which is immiscible with and more surface active than the lubricant; and a polyurethane binder which has a tensile elongation to break of at least 50% and a Young's modulus measured at a 2% elongation of at least 50000 lb/in$^2$; wherein the lubricant is present in an amount of at least 5 mg/m$^2$ and the additive is present in an amount of at least 25 wt percent relative to that of the lubricant, the amount of additive being effective to increase the coefficient of friction for the outermost layer after coating and drying thereof relative to that obtained in the absence of the additive material.

* * * * *